US008469038B2

(12) United States Patent
Sinclair, Jr.

(10) Patent No.: US 8,469,038 B2
(45) Date of Patent: Jun. 25, 2013

(54) SMOKING ARTICLE AND METHOD

(75) Inventor: Daniel S. Sinclair, Jr., Mandeville, LA (US)

(73) Assignee: Blunt Wrap U.S.A., Inc., Mandeville, LA (US)

( * ) Notice: Subject to any disclaimer, the term of this patent is extended or adjusted under 35 U.S.C. 154(b) by 25 days.

(21) Appl. No.: 13/182,957

(22) Filed: Jul. 14, 2011

(65) Prior Publication Data

US 2012/0006344 A1 Jan. 12, 2012

Related U.S. Application Data

(63) Continuation of application No. 12/108,946, filed on Apr. 24, 2008, now abandoned.

(60) Provisional application No. 60/915,994, filed on May 4, 2007.

(51) Int. Cl.
*A24B 3/14* (2006.01)

(52) U.S. Cl.
USPC ..... 131/369; 131/347; 131/360; 131/353; 131/365

(58) Field of Classification Search
None
See application file for complete search history.

(56) References Cited

U.S. PATENT DOCUMENTS 1,143,463 A * 6/1915 Terwilliger ..... 206/270
2006/0000481 A1 * 1/2006 Sinclair, Jr. ..... 131/347

* cited by examiner

*Primary Examiner* — Richard Crispino
*Assistant Examiner* — Phu Nguyen
(74) *Attorney, Agent, or Firm* — Garvey, Smith, Nehrbass & North, L.L.C.; Brett A. North

(57) ABSTRACT

A smoking article provides one or more sheets of material that can be rolled and packaged, at least one sheet including cellulose. In one embodiment, cellulose and tobacco sheet material are separately rolled layers that can optionally be wrapped around a form casing (or pre-rolled inside) and then packaged. In another embodiment, the sheet is a laminated sheet of tobacco and cellulose layers that can be optionally wrapped around (or pre-rolled inside) a form casing. These sheets can be filled with custom tobacco to make one or more new cigars for an end user. In another embodiment, a complete cigar filled with tobacco material can be disassembled by an end user to produce tobacco and cellulose sheets, enabling the end user to form two new cigars using his or her own custom tobacco.

10 Claims, 7 Drawing Sheets

10
14

10
14

12
11
14A
16

15
11
15
18
17
15

12
15
19

SMOKING ARTICLE AND METHOD

CROSS-REFERENCE TO RELATED APPLICATIONS

This is a continuation of U.S. patent application Ser. No. 12/108,946, filed Apr. 24, 2008, which application is a non-provisional of U.S. Provisional Patent Application Ser. No. 60/915,994, filed May 4, 2007. Each of these applications is incorporated herein by reference and priority of each is hereby claimed.

U.S. provisional patent application Ser. No. 60/870,490, filed Dec. 18, 2006, is incorporated herein by reference.

U.S. patent application Ser. No. 11/139,432, filed May 27, 2005, is incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

FIELD OF THE INVENTION

The present invention relates to tobacco products, namely unfilled or partially filled shells that enable a user to make a custom cigar using his or her own tobacco. More particularly, the present invention relates to a number of specially configured cigar and cigar shell embodiments that each enable a smoker to roll his or her own cigar. In some embodiments finished cigars are provided, some of which can be disassembled into multiple tubular shells that can each be custom filled with a user's own special tobacco or tobacco blend.

GENERAL BACKGROUND

In recent years, smoking of cigars has become fashionable and numerous cigar shops have opened around the world to satisfy this growing trend. The variety, quality and size of ready-made cigars satisfy the majority of the public. However, a small segment of connoisseurs insist that nothing can compare with the taste and smell of custom-blended tobacco products. These knowledgeable individuals are very selective in the manner in which their cigars are rolled and in the grade of tobacco used.

A still smaller segment of cigar aficionados prefers to roll their own cigars. They buy tobacco leaves or cigar wrapping and use their preferred brand of crushed tobacco. Some people buy inexpensive cigars, cut them with a sharp blade along the side and carefully pry the cut cigar open. The innermost layers are then removed and substituted with a favorite brand of crushed tobacco, which may come from cigarettes or bulk tobacco blend. The user then brings the cut edges of the cigar together, closing the outer layers of the cigar over the stuffing of selected tobacco. The edges are then sealed with a liquid or honey, and a new cigar is ready for a smoke.

Some reports indicate that the "roll-your-own" tobacco market is flourishing. In some countries, the roll-your-own products now hold a substantial share of the tobacco market, and their consumers represent more than 10% of the smoking population. This may be explained by the ability of a consumer to create a tailor-made product, as opposed to commercially available types of cigars.

U.S. Pat. No. 2,091,598 is incorporated herein by reference. Flat clear sheets of cellulose rolling paper are conventionally available. Most conventionally available clear cellulose are made from a mixture of cellulose, glycerin, and water. Cellulose can come from wood, cotton, or other sources of cellulose. The process is similar to that used to make cellophane. Some clear sheets are made from 80 percent Eucalyptus based cellulose, 14 percent glycerin, and 6 percent water. Glycerin can be used to control the rate of burn of the clear cellulose sheets.

U.S. patent application Ser. No. 10/957,462 filed Oct. 1, 2004, discloses a "Smoking Kit for Customizing a Tobacco Product" and is hereby incorporated herein by reference.

SUMMARY

Various embodiments of the present invention incorporate one or more clear cellulose sheets. These sheets can have a transparency of 75 percent, 80 percent, 85 percent, 90 percent, 95 percent, or higher or any combination of ranges between those percentages specified herein or between any combination of percentage ranges in one percent increments from 75 percent up to and including 100 percent.

One embodiment includes a smoking article that provides one or more sheets of material that can be rolled and packaged, at least one sheet including cellulose.

In various embodiments the sheets when laminated can be flat or non-rolled.

One embodiment includes cellulose and tobacco sheet material that are separate rolled layers that can each be optionally wrapped around a form casing and then packaged.

One embodiment includes a laminated sheet of tobacco and cellulose layers that can be optionally wrapped around a form casing. These sheets can each be filled with custom tobacco to make one or more new cigars for an end user.

One embodiment includes a complete cigar filled with tobacco material that can be disassembled by an end user to produce tobacco and cellulose sheets, enabling the end user to form two new cigars using his or her own custom tobacco.

One embodiment includes a tobacco article that provides a plurality of pre-rolled sheets of smokable material that are each flexible and configured to be rolled into a generally tubular form that enables containment of tobacco material. The sheets of material including a first sheet that contains tobacco and a second sheet that does not contain tobacco and that includes cellulose. A form casing is provided, wherein the sheets of material are rolled together around the form casing. A package contains the sheets and form casing. One embodiment includes the second sheet of material being transparent.

One embodiment includes a tobacco article having a first sheet that is a laminate of a first layer that includes tobacco material and a second layer that includes cellulose or like clear sheet material. An adhesive layer bonds the tobacco layer and clear sheet layer together. A form casing can be provided, wherein the sheet is rolled in a generally tubular shape, supported by the form casing. A package contains the sheets and form casing. The sheets are not completely filled with a tobacco filler.

One embodiment includes a tobacco article that has a first sheet that is a laminate of a first layer that includes tobacco material and a second layer that includes cellulose. An adhesive layer bonds the first and second layers together. The laminate is flexible, enabling it to be rolled into a generally tubular form. A package contains the laminate. The generally tubular form is not completely filled with a tobacco filler. One embodiment includes the cellulose sheet being transparent.

One embodiment includes a tobacco article that provides a first sheet that is a laminate of a first layer that includes tobacco material and a second layer that includes cellulose. An adhesive layer bonds the first layer and second layers together. The laminate is pre-rolled into a generally conically shaped form. A package contains the conically shaped form. The conically shaped form has an opening that can be filled with a tobacco filler material.

One embodiment includes a tobacco article that has a plurality of sheets of material. The sheets of material include a first sheet that contains tobacco and a second sheet that does not contain tobacco and that includes cellulose. The sheets of material are pre-rolled in the form of a cone shaped shell. A package contains the cone shaped shell. The sheets can be smoked by a human consumer.

One embodiment includes a cigar that has a first sheet comprising tobacco material and a second sheet comprising cellulose. The first and second sheets are pre-rolled in a tubular shell that includes a central storage area. The central storage area is filled with tobacco filler material and forming a tubular shell filled cigar body. A package contains the filled tubular shell. At least one of the first and second sheets are lightly bonded allowing a user to disassemble the first and second sheets without substantially damaging either sheet so that the user can reuse either sheet alone on in combination to roll anew cigar with a preferred tobacco filler material. One embodiment includes a cellulose sheet as either the first and/or second sheet. One embodiment has the cellulose sheet being transparent.

One embodiment includes a cigar having a cigar body with end portions, an outer shell of one or more sheets of material that are flexible and configured to be rolled into a generally tubular form, and a central storage area that can store tobacco filler material. The one or more sheets of material include at least one sheet that does not contain tobacco and comprises cellulose. Tobacco filler is stored in the central storage area. The at least one sheet of material is rolled together around the filler. A package contains the cigar body. Each sheet can be safely smoked by a human consumer. A mouth piece can be attached to one end portion of the cigar body.

One embodiment includes a cigar having a cigar body that includes a first sheet that is a laminate of a first layer that comprises tobacco material and a second layer that comprises transparent cellulose. An adhesive layer bonds the tobacco layer and the cellulose layer together. The laminate is a generally tubular form having a central storage area. A package contains the cigar body. The central storage area is at least partially filled with a tobacco filler. One end portion of the cigar body may be fitted with a mouth piece.

One embodiment includes a tobacco article that has a sheet that is a layer that includes cellulose and a form casing. The sheet is pre-rolled in a generally tubular shape. The generally tubular shape is supported by the form casing. A package contains the form casing and sheet. The generally tubular shape has a storage area for containing a tobacco filler.

One embodiment includes a tobacco article that has one or more sheets of material that are flexible and configured to be rolled into a generally tubular form having a bore that enables containment of tobacco material. The sheet or sheets of material include at least one sheet that does not contain tobacco and that includes cellulose. A form casing is provided. The sheet or sheets of material are rolled together in a generally tubular shape which is supported by the form casing. A package contains the sheet or sheets, one being a cellulose containing sheet that can be smoked by a human consumer.

One embodiment provides clear pre-rolled sheets for fabricating and making custom made tobacco product, and a method of making such tobacco product that includes preferably tobacco, and more preferably tobacco leaves.

One embodiment provides various configurations of clear pre-rolled sheets. One embodiment includes a layered configuration of clear pre-rolled sheets including a first sheet of homogenized tobacco paper, a second clear sheet, and a third sheet of homogenized tobacco paper. One embodiment includes a layered configuration of pre-rolled sheets including a first sheet of natural leaf, a second clear sheet, and a third sheet of natural leaf.

One embodiment includes a plurality of sheets numbering 2, 3, 4, 5, 6, 7, 8, 9, 10, 11, 12, 13, 14, 15, 16, 17, 18, 19, 20, 21, 22, 23, 24, 25, 26, 27, 28, 29, or 30. Various embodiments include possible ranges between any of the combinations of the above listed numbers. For example, between 3 and 20, 5 and 15, etc. In various embodiments one or more of the sheets comprise cellulose. In various embodiments one or more of the sheets comprise homogenized tobacco paper. In various embodiments one or more of the sheets comprise a laminate of a cellulose layer and a tobacco layer (where the tobacco layer can be either homogenized tobacco or natural leaf).

One embodiment includes cellulose sheets (e.g., clear or non-clear) in combination of sheets made of other materials such as homogenized tobacco paper, natural leaf, hemp, hemp paper, cotton paper, rolling paper, and/or sheets of other smokable materials.

One embodiment includes possible combinations of the different types of clear sheets along with sheets of homogenized tobacco paper, natural leaf, rolling paper, and/or sheets of other smokable materials.

One embodiment includes cellulose sheets in combination with sheets comprised of different smokable materials chosen from any combination of the following types of materials: natural leaf, homogenized tobacco paper, hemp, hemp paper, cotton paper, transparent cellulose, non-transparent cellulose, pipe tobacco, different types of flavored tobacco, tea leaves, kanna, blue lotus, salvia, salvia eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, Capillarius herba, Yerba Lenna Yesca, Calea Zacatechichi, Leonurus Sibericus Flowers, Wild Dagga Flowers, Klip Dagga Leaf, Damiana, Hookah, Hemia salicifolia, Kava Kava, Avena Sativa, scotch broom topps, Valarian, capillarius, herba, Wild clip dagga, Leonurus sibiricus, Kanna, Sinicuichi, and/or lactuca virosa.

In one embodiment includes multiple types of filler material which offers the consumer the option of using different types of filler and/or blending between the types of filler included. In one embodiment different types of filler material can be chosen from any combination of the following types of filler material: pipe tobacco, different types of flavored tobacco, tea leaves, karma, blue lotus, salvia, salvia eivinorm, wild dagga, kratom, herbal non-tobacco, Celandine Poppy, Mugwort, Purple Lavender Flowers, Coltsfoot Leaf, Ginger root, California Poppy, Sinicuichi, St. John's Wort, Capillarius herba, Yerba Lenna Yesca, Calea Zacatechichi, Leonurus Sibericus Flowers, Wild Dagga Flowers, Klip Dagga Leaf, Damiana, Hookah, Hernia salicifolia, Kava Kava, Avena Sativa, scotch broom topps, Valarian, capillarius, herba, Wild clip dagga, Leonurus sibiricus, Kanna, Sinicuichi, and/or lactuca virosa.

One embodiment provides various form casings which can support one or more clear pre-rolled sheets, which sheets can be used to make one or more finished tobacco products (e.g., cigars and/or cigarettes).

In various embodiments form casings can be comprised of one or more of the following materials or combinations of materials: filter material, sponge, cotton, paper, cardboard, wood, metal, tobacco, hemp, hemp paper, clove, mir, willow bark, dogwood cornus sp, red osier, pipsissewa, chimaphila, pyrola, kinnikinnik, arctostaphylos uva-ursi, camomile herbs, manzanita, shrubby arctostaphylos sp, madrone, arbutus menziesii, blackberry, rubus sp, scotch broom, cytisus, scoparius, cannabis, hemp THC-free, calamus, mullein, and/or verbascum thapsus. In various embodiments form casings can be comprised of sticks, tobacco sticks, and/or pipe cleaners. In one embodiment filter material can be comprised of acetate, paper, plastic, polymer, cotton, charcoal, and/or a combination of one or more of the specified materials.

One embodiment provides form casing(s) which can include filler material at least partially contained by anon-smokable outer holder. In one embodiment, an outer portion of non-smokable material contains the tobacco filler and separates the filler from any pre-rolled sheets located around the form casings. In one embodiment the form casing supports the pre-rolled sheet(s) which can be contained inside the form casing with an outer layer of the form casing containing tobacco filler material.

One embodiment includes a first form casing which can support one or more clear pre-rolled sheets for forming one or more finished tobacco products (such as cigars and/or cigarette), along with a finished tobacco product, such as a finished cigar or cigarette which is packaged with the first form casing and the one or more pre-rolled sheets for forming finished tobacco products.

One embodiment includes a first form casing which can support multiple clear pre-rolled sheets for forming finished tobacco products, such as a finished cigar(s) or cigarette(s) which is packaged with the first form casing and the pre-rolled sheets for forming one or more finished tobacco products. One embodiment includes a layered configuration of clear pre-rolled sheets including a first sheet of homogenized tobacco paper, a second clear sheet, and a third sheet of homogenized tobacco paper. One embodiment includes a layered configuration of pre-rolled sheets including a first sheet of natural leaf, a second clear sheet, and a third sheet of natural leaf. In other embodiments various possible permutations of these three types of pre-rolled sheets can be used.

One embodiment includes a first form casing which can support one or more clear pre-rolled sheets for forming finished tobacco products (such as cigars and/or cigarette), along with a quantity of tobacco product which can be used as tobacco filler for forming the finished tobacco products (such as cigars and/or cigarettes). In one embodiment the quantity of tobacco product is formed in a cylindrical shape around which at least one pre-rolled sheet can be wrapped to form a finished tobacco product. In one embodiment the quantity of tobacco product is itself wrapped with a wrapper that is separate from the one or more pre-rolled sheets. In one embodiment the quantity of tobacco product is contained in a box and packaged with the one or more pre-rolled sheets for forming finished tobacco product. In one embodiment, the tobacco product is loosely packaged with the first form casing and one or more pre-rolled sheets for forming finished tobacco products.

One embodiment provides form casings including moisturizing agents which can permeate and/or migrate from the form casing to the pre-rolled sheet(s).

One embodiment provides form casings including flavoring agents which can permeate and/or migrate from the form casing to the pre-rolled sheet(s).

One embodiment provides form casings including scenting agents which can permeate and/or migrate from the form casing to the pre-rolled sheet(s).

One embodiment includes a cigar tip which can be used with the finished tobacco products. One embodiment includes a cigar tip attached to the at least one pre-rolled sheet before a sheet is formed into a finished cigar, such as when the at least one pre-rolled sheet is packaged for sale pre-rolled, but in an unfinished state.

The method of the present invention thus enables an end user to make his or her own custom finished tobacco products with a selected, custom filler material or blend of filler material. The method preferably includes the use of a liquid for moisturizing, and also preferably includes flavoring and/or scenting. The liquid can be, in whole or in part, water, alcohol, solvent, oil, propylene glycol, ethyl alcohol, glycerin, benzyl alcohol as examples. The liquid can be flavored and/or scented with items such as for example apple, apple martini, berries, blueberry, champagne, chocolate, coco/vanilla, cognac, cosmo, gin, grape, honey, lychee, mango, menthol, mint choco, peach, piña colada, punch, purple, rum, strawberry-kiwi, vanilla, watermelon, wet cherry, and/or whiskey.

The flavors are preferably added to the form casings and/or pre-rolled sheets with a liquid. This flavored liquid is typically applied at levels of between about 0.01 to 45% by weight, and preferably between about 0.1% to 10% by weight and more preferably between 1 and 8%. This flavored liquid is typically applied to the at least one pre-rolled sheet with a carrier liquid such as ethyl alcohol, propylene glycol, water or the like. Glycerin and invert sugar can also be used as a carrier. Some humectants can also be used; however, little or no humectants can be used. In general terms, the flavors can be provided by botanical extracts, essential oils, or artificial flavor chemicals, any one of which or a combination thereof mixed with a carrying solvent such as propylene glycol, ethyl alcohol, glycerin, benzyl alcohol, or other alcohol, for example. Other flavors can include cocoa, licorice, coffee, vanilla or other botanical extracts. Essentials oils can be used such as wine essence, cognac oil, rose oil, mate or other oils.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
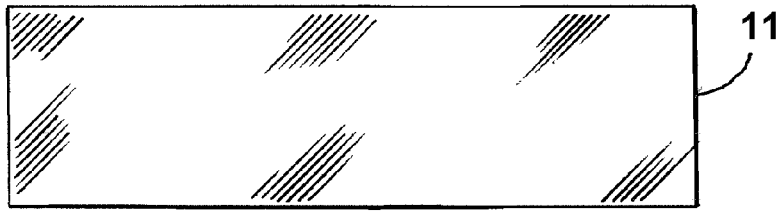
FIG. 1 is a partial perspective view of the preferred embodiment of the apparatus of the present invention.
Figure 2:
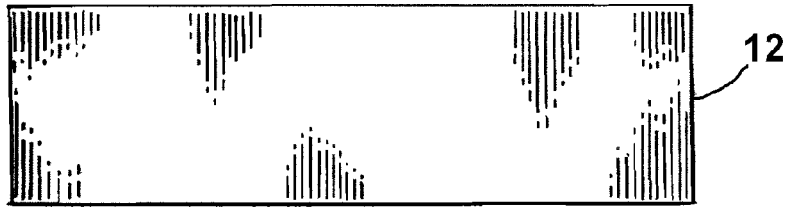
FIG. 2 is a partial perspective exploded view of the preferred embodiment of the apparatus of the present invention.
Figure 3:
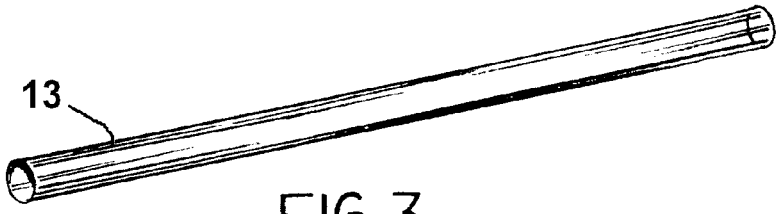
FIG. 3 is a partial perspective exploded view of the preferred embodiment of the apparatus of the present invention.
Figure 4:
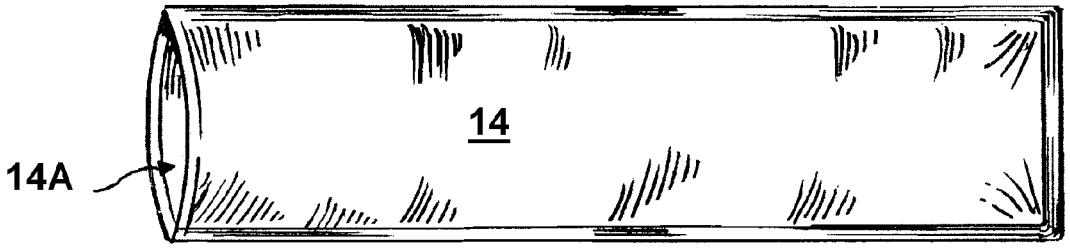
FIG. 4 is a partial perspective exploded view of the preferred embodiment of the apparatus of the present invention.
Figures 5, 6, 7, 8:
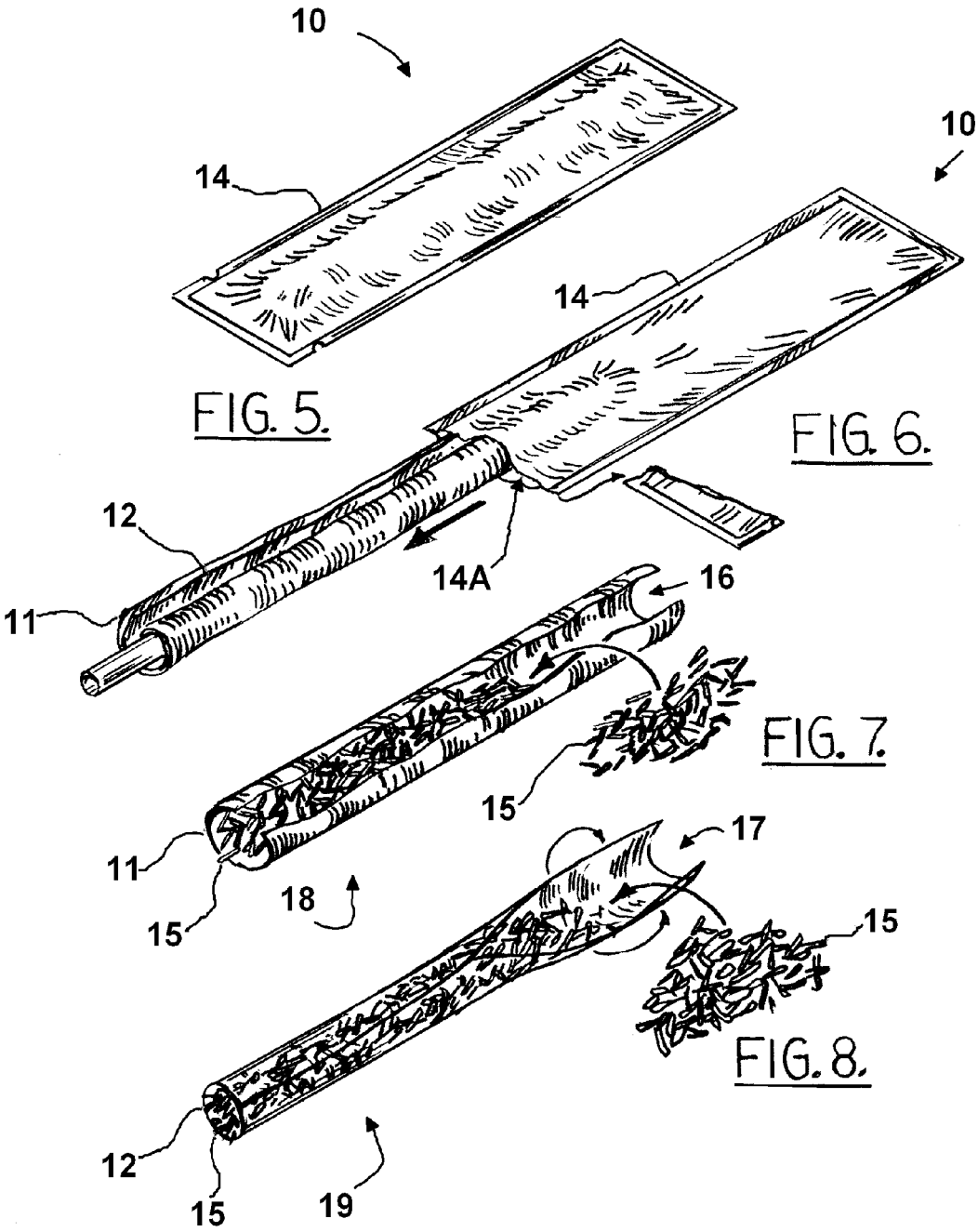
FIG. 5 is a perspective view of the preferred embodiment of the apparatus of the present invention.
FIG. 6 is a perspective view of the preferred embodiment of the apparatus of the present invention.
FIG. 7 is a partial perspective view of the preferred embodiment of the apparatus of the present invention.
FIG. 8 is a perspective view of the preferred embodiment of the apparatus of the present invention.

FIGS. 1-8 show a first, preferred embodiment of the apparatus of the present invention designated generally by the numeral 10 in FIGS. 6-7. Smoking article 10 provides a tobacco sheet 11 and a cellulose sheet 12. The two sheets 11, 12 are preferably rolled together and around a form casing 13. Alternatively, the sheets can be pre-rolled and placed inside form casing 13. The form casing 13 can be for example a polypropylene or other plastic tube. After the two sheets 11, 12 are wound or wrapped around the form casing 13, they are packaged inside of a package 14. Package 14 can be a foil or plastic sealed package having an interior 14A that contains the sheets 11, 12 rolled around form casing 13. Package 14 can be of a material (e.g. foil or plastic) that prevents substantial loss of moisture. Sheets 11, 12 are preferably packaged in roll form and unfilled (see FIGS. 5-6).

A user can take either of the tobacco sheet 11 or cellulose sheet 12 and form a new cigar as illustrated in FIGS. 7 and 8. The sheet 11 is preferably comprised of tobacco material such as a tobacco leaf material or a homogenized tobacco sheet material and retains a rolled or cylinder form even after removal from package 14 (and form casing 13). The rolled sheet 11 provides a central storage area, bore, or space 16 that can be filled with tobacco filler 15 (see FIG. 7) and rolled to form a new formed cigar 18 as shown in FIG. 7. Similarly, the rolled sheet 12 can be provided with a central storage area, bore, or space 17 that is receptive of tobacco filler 15. The sheet 12 can be rolled around the tobacco filler 15 as shown in FIG. 8 for forming anew cigar 19. Each sheet 11 or 12 can be filled with selected tobacco filler 15 can be sealed with moisture, tobacco glue or the like.

Figure 9:
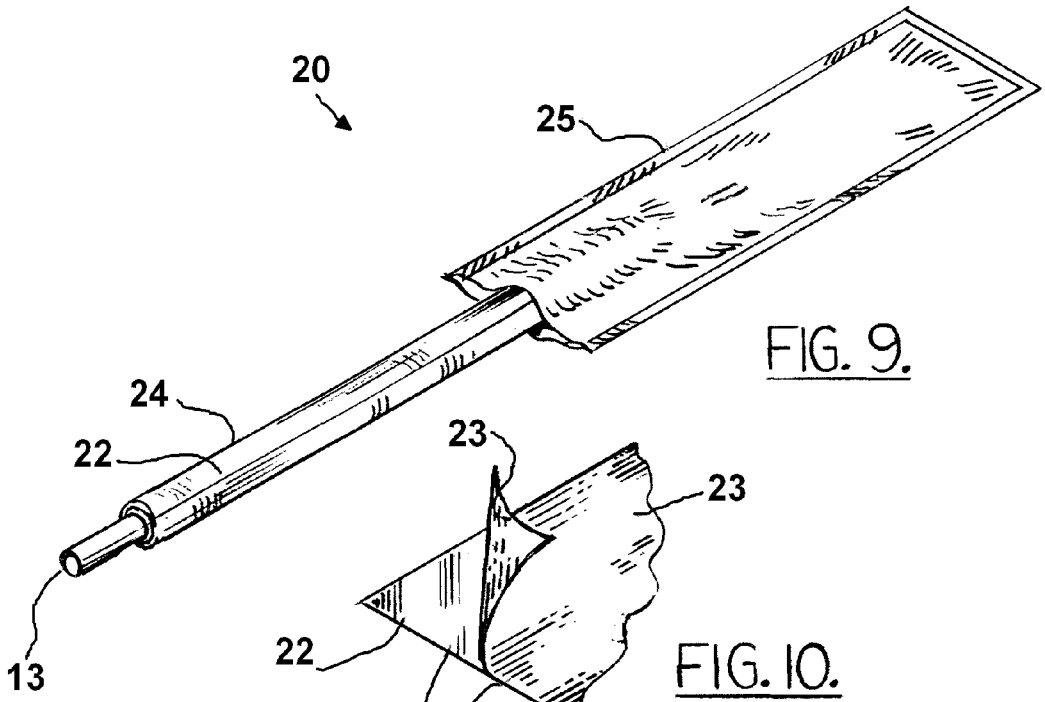
FIG. 9 is a perspective view of a second embodiment of the apparatus of the present invention.
Figure 10:
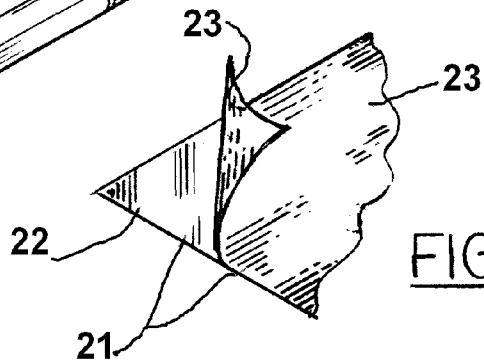
FIG. 10 is a perspective view of a second embodiment of the apparatus of the present invention.

FIGS. 9-10 show a second embodiment of the apparatus of the present invention designated generally by the numeral 20. Smoking article 20 employs a laminated sheet 21. Laminated sheet 21 includes a cellulose layer 22 that can be transparent and a tobacco layer 23. The smoking article 20 employs a laminated rolled sheet 24 having a central storage area, bore, space, or interior that is receptive of a user's custom tobacco. The sheet 24 can be rolled or wrapped around form casing 13 (FIG. 9) and then contained within package 25. The sheet 24 can alternatively be rolled into a tubular shape and without form 13 (see FIG. 11), then packaged within package 25. Package 25 can be a foil or film or vacuum type package that prevents substantial loss of moisture. The laminated sheet 21 of FIGS. 9, 10 and 11 preferably includes a cellulose layer 22 and tobacco layer 23 that are laminated or joined using tobacco glue as an example. The glue that is used to join the two layers 22, 23 together can be flavored or scented. The tobacco layer 23 can be leaf, whole leaf tobacco or homogenized tobacco. The cellulose layer 22 is preferably an outer layer of rolled laminated sheet 24 to aid in moisture retention.

Figure 11:
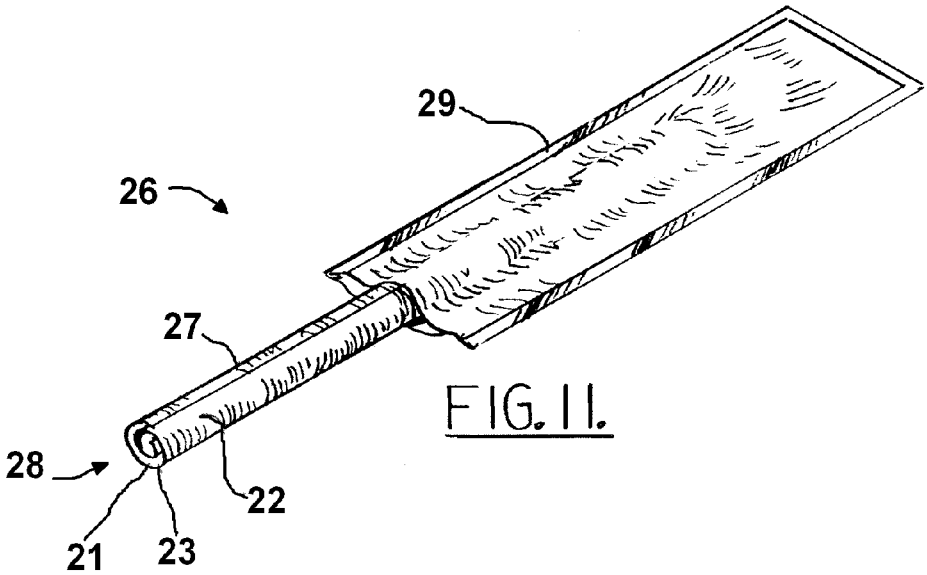
FIG. 11 is a partial perspective view of a third embodiment of the apparatus of the present invention.

FIG. 11 shows a third embodiment of the apparatus of the present invention designated generally by the numeral 26. Smoking article 26 provides a rolled sheet 27 that is of a laminated material. Sheet 27 can be the laminated sheet 21 of FIGS. 9-10. Thus, the rolled sheet 27 can be a laminate of a cellulose layer 22 and a tobacco layer 23. Rolled sheet 27 has a bore or interior 28 for containing custom tobacco. In FIG. 11, the rolled sheet 27 is placed inside package 29 and without being wrapped around any form casing. When rolled, the cellulose layer 22 is preferably the outer layer as shown in FIG. 11, thus enhancing the retention of moisture. The tobacco layer 23 thus faces inwardly and contacts any custom tobacco that is added to the bore or interior 28 of the rolled sheet 27 when an end user forms his or her own cigar.

Figure 12:
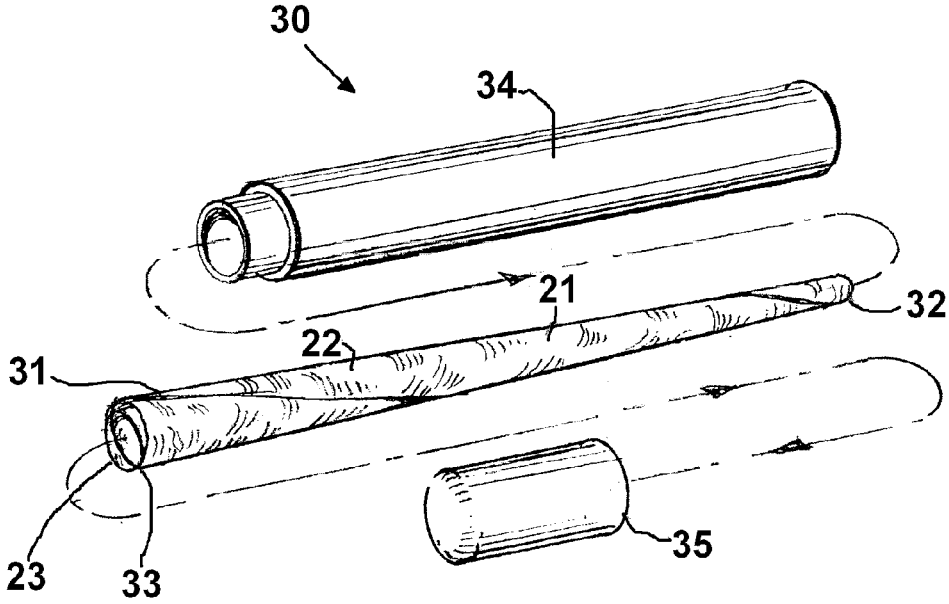
FIG. 12 is a perspective view of a fourth embodiment of the apparatus of the present invention.
Figure 13:
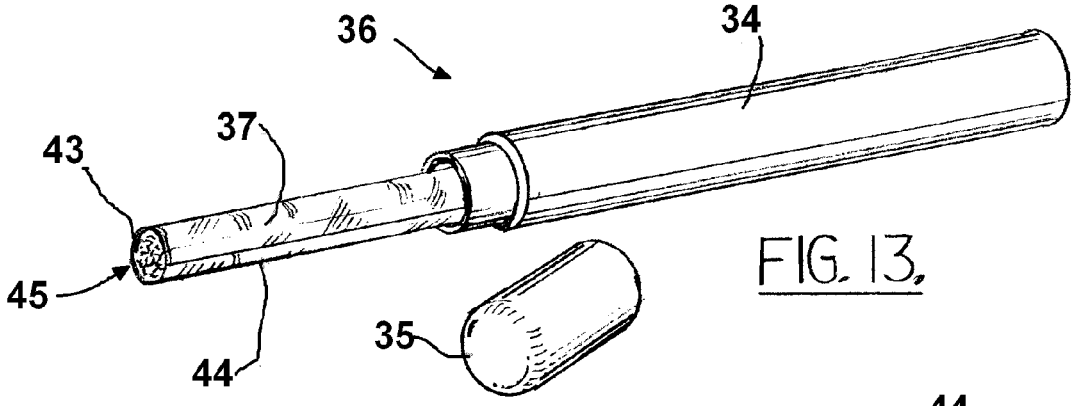
FIG. 13 is a perspective view of a fifth embodiment of the apparatus of the present invention.
Figure 14:
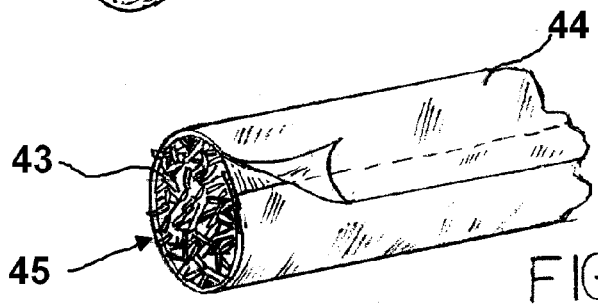
FIG. 14 is a partial perspective view of a fifth embodiment of the apparatus of the present invention.

FIGS. 12-14 show a fourth embodiment of the apparatus of the present invention designated generally by the numeral 30. Smoking article 30 provides a cone-shaped tube 31 having a smaller diameter end portion 32, a larger diameter end portion 33 and a cone shaped interior or bore 64 that is receptive of a user's custom tobacco filler. The cone-shaped tube 31 can be packaged empty or filled with tobacco or partially filled with tobacco and placed within container 34. A closure cap 35 can be used to close container 34 after cone-shaped tube 31 is placed therein, as shown in FIG. 12. Cone-shaped tube 31 is preferably formed with a laminated sheet such as sheet 21 that was shown and described with respect to the embodiments of FIGS. 9-11. The smaller diameter end portion 31 can be fitted with a filter internally or with a mouth piece. In FIG. 12, the laminated sheet 21 is preferably wound in a cone-shape to provide cone-shaped tube 31 that generally retains its shape once formed. Sheet 21 provides a tobacco layer 23 that is preferably an inner layer. Sheet 21 provides cellulose layer 22 that is preferably an outer layer. The tobacco layer 23 can be sheet or leaf tobacco or homogenized tobacco. A user would typically unroll tube 31 to add custom tobacco, then roll back and close with moisture, cigar glue or the like.

Figure 15:
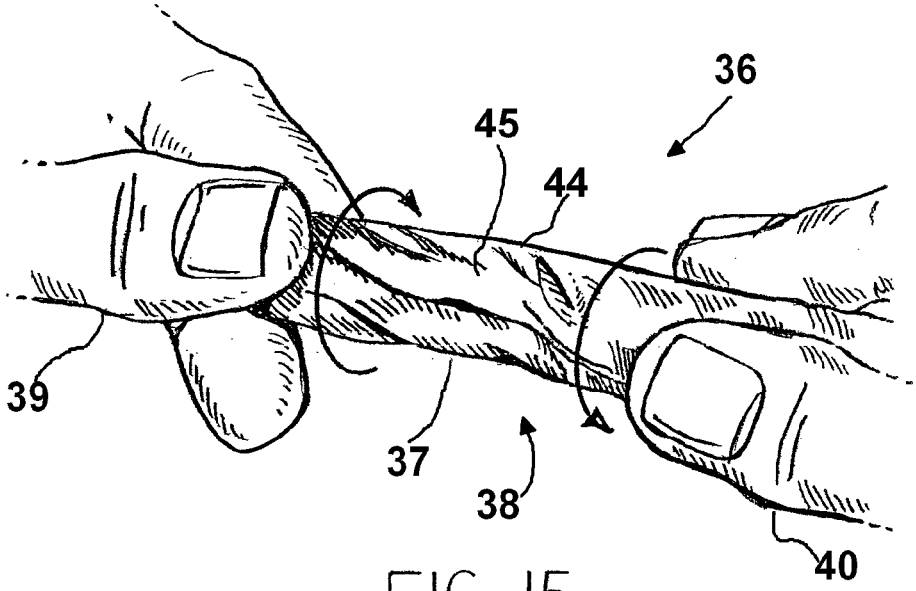
FIG. 15 is a partial perspective view of a fifth embodiment of the apparatus of the present invention illustrating disassembly of the cigar to provide multiple shells.
Figure 16:
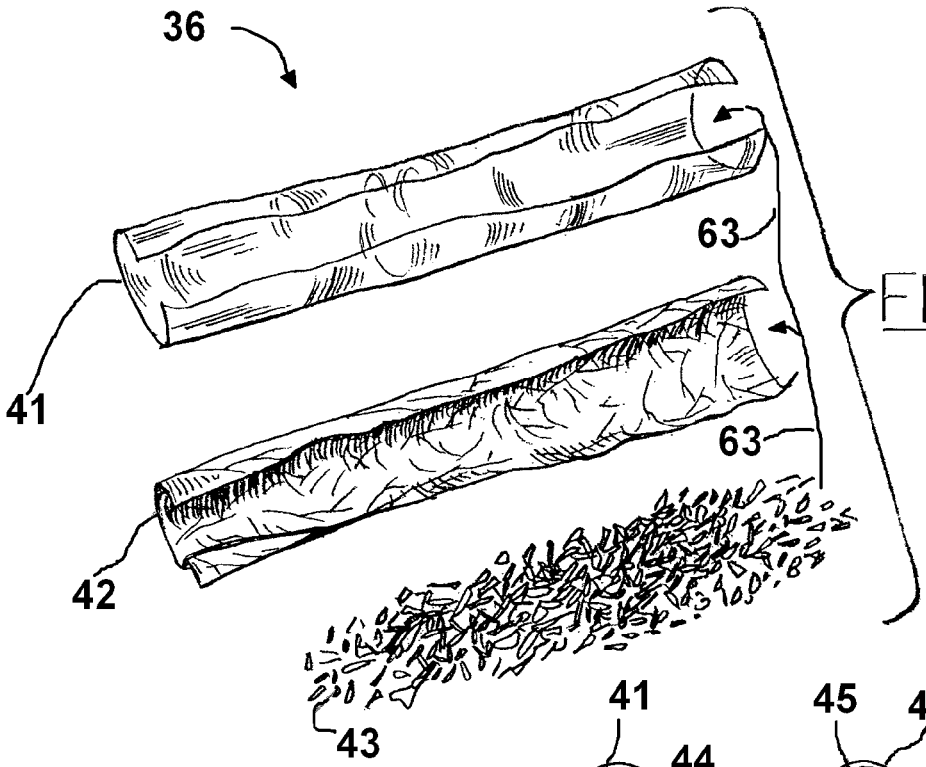
FIG. 16 is a partial perspective view of a fifth embodiment of the apparatus of the present invention.

FIGS. 13-18 show a fifth embodiment of the apparatus of the present invention designated generally by the numeral 36. Smoking article 36 provides a cigar 37 that has a cylindrically shaped or tubular shell 44. The shell 44 has a shell bore 45 that is filled or partially filled with a tobacco filler 43. The shell 44 is comprised of a pair of separable layers including a first layer 41 and a second layer 42. Cigar 37 can be contained within container 34 and cap 35. FIG. 15 illustrates that the cigar 37 can be easily separated as it is only lightly glued together. By simply twisting the cigar 37 as illustrated in FIG. 15 to create twisted section 38, a user can grip the ends of the cigar 37 with his or her hands 39, 40 and break the very light glue seal that holds cigar 37 together. Once broken apart, the layers 41, 42 can be separated and exposed as shown in FIG. 16. They can then be spaced apart as shown in FIG. 16 enabling the user to fill each one of the layers 41, 42 with his or her own custom tobacco filler 43. The filler 43 supplied by the user can be either a completely new filler 43 or can be mixed with the existing filler 43 that was supplied with the cigar 37 as purchased.

Figure 17:
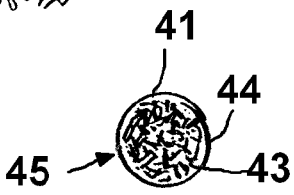
FIG. 17 is a perspective end view of a fifth embodiment of the apparatus of the present invention.
Figure 18:
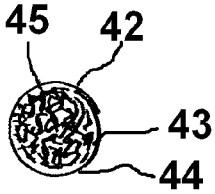
FIG. 18 is a perspective end view of a fifth embodiment of the apparatus of the present invention.
Figure 19:
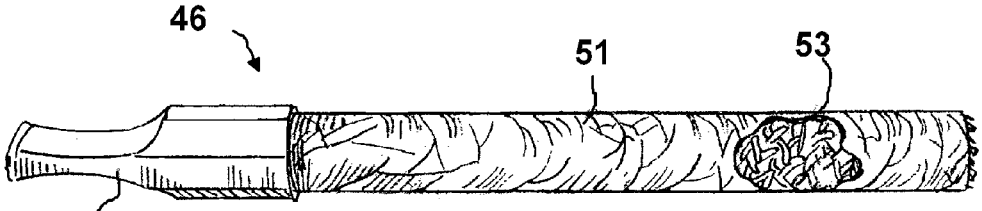
FIG. 19 is a perspective view of a sixth embodiment of the apparatus of the present invention.

FIG. 16 illustrates the manufacture of a new cigar by adding tobacco filler 43 to the first layer 41 or to the second layer 42 (see arrows 63). The first layer 41 is preferably of a transparent cellulose sheet material. Alternatively, the cellulose sheet can be non-transparent. In FIG. 19, the layer 42 is a tobacco layer that can be leaf tobacco material or homogenized tobacco material. In FIG. 17, filler 43 has been added to the sheet 41. In FIG. 18, filler 43 has been added to sheet 42. In either case, the sheet 41 or 42 can be rolled with a user's custom tobacco to make two new cigars from the single purchased cigar 37. Moisture or cigar glue can be used to hold each layer 41, 42 in a tube shape after filler 43 has been added to the sheet 41 or 42.

Figure 20:
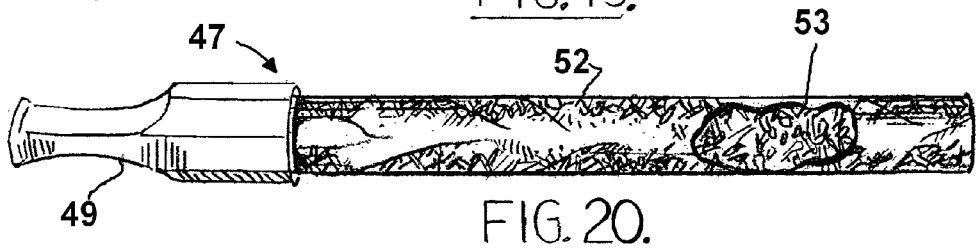
FIG. 20 is a perspective view of a sixth embodiment of the apparatus of the present invention.
Figure 21:
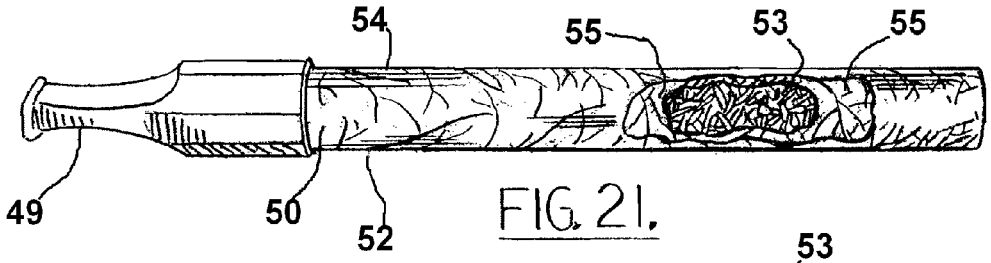
FIG. 21 is a partial perspective view of the sixth embodiment of the apparatus of the present invention.
Figure 22:
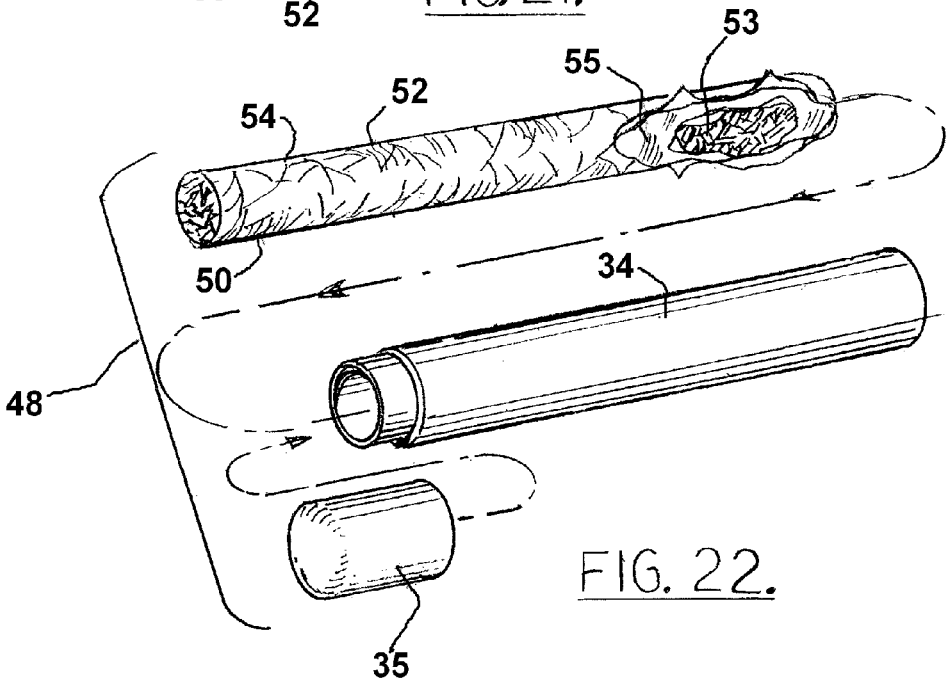
FIG. 22 is a partial exploded perspective view of the sixth embodiment of the apparatus of the present invention.

FIGS. 19-22 show a sixth embodiment of the apparatus of the present invention in the form of complete cigars that are designated generally by the numerals 46, 47 and 48 in FIGS. 19-21. In each of the smoking articles 46, 47, 48, a completed cigar with a mouth piece 49 is provided. Mouth piece 49 is positioned at one end portion of each article 46, 47, 48 as shown. The cigars 46, 47, 48 each provide a tobacco filler 53. However, each smoking article 46, 47, 48 has a different outer shell or layering. Smoking article 46 has a cellulose shell 51 that is transparent, the tobacco filler 53 showing through in FIG. 19. Smoking article 47 has a tobacco layer shell 52 filled with tobacco filler 53. Smoking article 48 has a laminated sheet shell 50 that can be a lamination of a tobacco sheet, and a cellulose sheet as with the embodiments of FIGS. 9-14. Smoking article 48 positions the laminated sheet shell 50 such that the outer layer is a tobacco layer 54 and the inner layer is a cellulose sheet 55. In FIG. 21, apart of the tobacco sheet outer layer 54 has been removed to show the inner cellulose layer 55. Alternatively, cellulose layer 55 can be the inner layer, and tobacco sheet layer 54 can be the outer layer. In FIG. 22, the mouth piece 49 has been removed for further illustration. A container 34 having cap 35 can be used to contain each cigar 46, 47, 48 (see FIG. 22).

Figure 23:
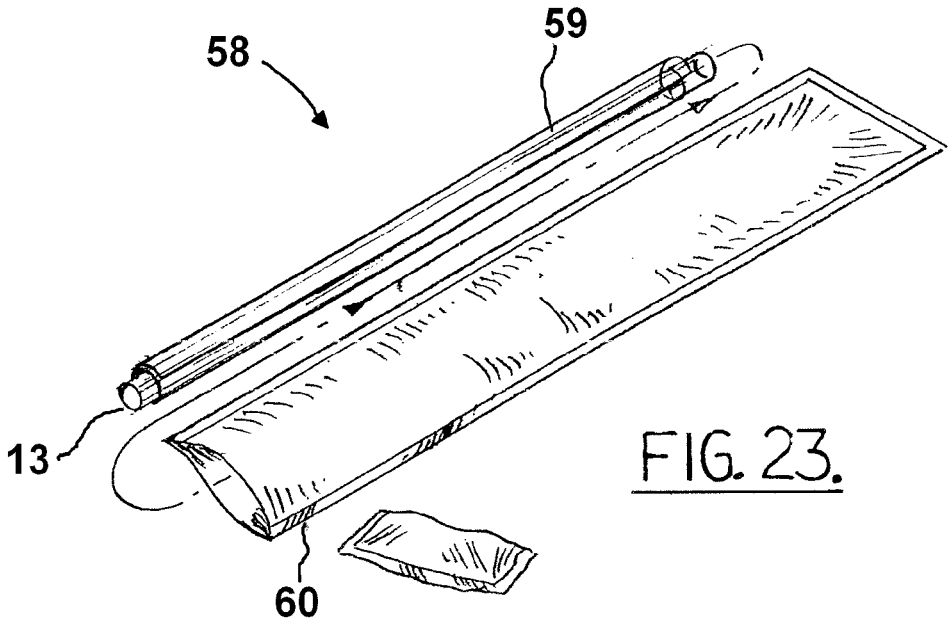
FIG. 23 is a perspective view of a seventh embodiment of the apparatus of the present invention.
Figure 24:
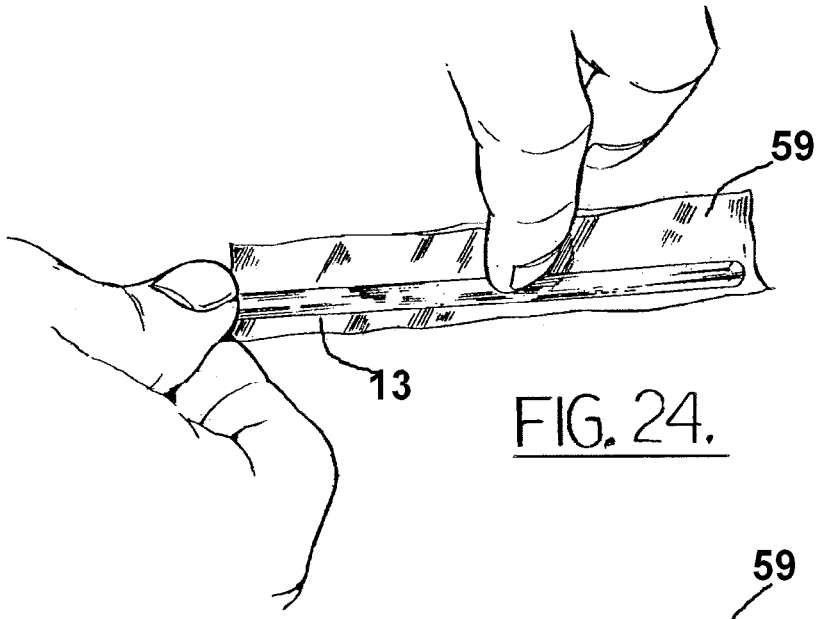
FIG. 24 is a perspective view of a seventh embodiment of the apparatus of the present invention.
Figure 25:
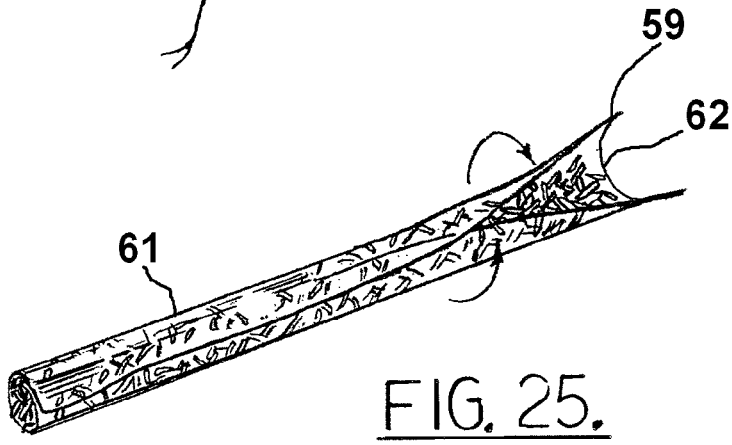
FIG. 25 is a partial perspective view of a seventh embodiment of the apparatus of the present invention.

FIGS. 23-25 show a seventh embodiment of the apparatus of the present invention designated generally by the numeral 58. Smoking article 58 provides a cellulose sheet 59 that is wound upon a form casing 13 and contained inside a package 60. The cellulose sheet 59 is thus rolled, wrapped about the form casing 13 to provide a tubular form 61 that can be removed from package 60 by an end user, then filled with a user's custom tobacco filler 62 as shown in FIG. 27. Alternatively, sheet 59 can be pre-rolled and inserted inside form casing 13. In FIG. 28, the rolled cigar 58 comprising cellulose sheet 59 and tobacco filler 62 can be contained in a container 34 with cap 35 as shown in FIGS. 12-13 and 22.

The following is a list of parts and materials suitable for use in the present invention.

PARTS LIST

| Part Number | Description |
|---|---|
| 10 | smoking article |
| 11 | tobacco sheet |
| 12 | cellulose sheet |
| 13 | form casing |
| 14 | package |
| 14A | interior |
| 15 | tobacco filler |

-continued

PARTS LIST

| Part Number | Description |
|---|---|
| 16 | bore/space |
| 17 | bore/space |
| 18 | formed cigar |
| 19 | formed cigar |
| 20 | smoking article |
| 21 | laminated sheet |
| 22 | cellulose layer |
| 23 | tobacco layer |
| 24 | rolled sheet |
| 25 | package |
| 26 | smoking article |
| 27 | rolled sheet |
| 28 | interior |
| 29 | package |
| 30 | smoking article |
| 31 | cone shaped tube |
| 32 | smaller diameter end portion |
| 33 | larger diameter end portion |
| 34 | container |
| 35 | closure cap |
| 36 | smoking article |
| 37 | cigar |
| 38 | twisted central section |
| 39 | consumer's hand |
| 40 | consumer's hand |
| 41 | first layer |
| 42 | second layer |
| 43 | tobacco filler |
| 44 | shell |
| 45 | shell bore |
| 46 | smoking article |
| 47 | smoking article |
| 48 | smoking article |
| 49 | mouth piece |
| 50 | laminated sheet shell |
| 51 | cellulose shell |
| 52 | tobacco shell |
| 53 | tobacco filler |
| 54 | tobacco sheet outer layer |
| 55 | cellulose sheet |
| 58 | smoking article |
| 59 | cellulose sheet |
| 60 | package |
| 61 | tubular form |
| 62 | tobacco filler |
| 63 | arrow |
| 64 | cone shaped interior or bore |
| 65 | arrows |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of fabricating a plurality of custom cigars from a single cigar comprising:

(a) providing a cigar, the cigar comprising:

(i) a cigar shell having a cylindrically shaped or tubular shell;

(ii) the shell having a longitudinal axis and bore with first and second longitudinal ends, and a first tobacco filler in the shell;

(iii) the shell comprised of a pair of separable sheets, having first and second sheets;

(iv) a light glue seal that holds the shell together;

(v) wherein a user can grip the shell at the first and second ends, twist in opposite directions which directions are substantially perpendicular to the longitudinal axis, causing the shell to open and the first and second sheets to separate; and (vi) a package that contains the shell;

(b) removing the shell from the package;

(c) gripping the shell on the first and second ends;

(d) twisting the first and second ends in opposite directions in directions substantially perpendicular to the longitudinal axis, causing the light glue seal to break, the shell to open, and the first and second sheets to separate;

(e) forming a first custom cigar with the first sheet; and (f) forming a second customer cigar with the second sheet.

2. The method of claim 1, wherein a second tobacco filler is used in step "e".

3. The method of claim 1, wherein a second tobacco filler is used in step "f".

4. The method of claim 1, wherein the first tobacco filler is used in steps "e" and "f".

5. The method of claim 1, wherein step "a" the first sheet is homogenized tobacco material.

6. The method of claim 1, wherein step "a" the second sheet is cellulose.

7. The method of claim 1, wherein step "a" the second sheet is transparent.

8. The method of claim 1, wherein step "a" the package includes a tube.

9. The method of claim 8, wherein the tube includes a detachable cap.

10. The method of claim 1, wherein in step "d" the twisting in opposite directions is simultaneously done.

* * * * *